US006371809B1

(12) United States Patent
Chun-Yuan

(10) Patent No.: US 6,371,809 B1
(45) Date of Patent: Apr. 16, 2002

(54) MOBILE PHONE CONNECTOR

(75) Inventor: Chen Chun-Yuan, Taipei Hsien (TW)

(73) Assignee: L&K Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 09/607,854

(22) Filed: Jun. 29, 2000

(51) Int. Cl.[7] ..... H01R 13/648
(52) U.S. Cl. ..... 439/607; 439/79
(58) Field of Search ..... 439/79, 607, 608–610

(56) References Cited

U.S. PATENT DOCUMENTS 6,077,120 A * 6/2000 Futatsugi et al. ..... 439/607
6,083,046 A * 7/2000 Wu et al. ..... 439/607
6,139,350 A * 10/2000 Mathesius ..... 439/607

* cited by examiner

*Primary Examiner*—Gary Paumen
(74) *Attorney, Agent, or Firm*—Pro-Techtor International Services

(57) ABSTRACT

A mobile phone connector for connecting a DC charging plug (61) with a mobile phone has an insulating unit (1) and an integral enveloping unit (2) shielding the insulating unit therein. The insulating unit defines a plurality of terminal accommodating grooves (10) and contact point terminal accommodating grooves (11, 12). The insulating unit has a first charging terminal unit (13) and a second charging terminal unit (14) extending from an end of the first charging terminal unit. A pair of charging terminals (5) are respectively received in the first and the second charging terminal units. The enveloping unit, the first charging terminal unit and the second charging terminal unit defines a DC charging slot (16) for accommodating a portion of the DC charging plug. The second charging terminal unit is shorter than a transverse portion (130) of the first charging terminal unit for preventing misconnection of the mating external device with the mobile phone.

12 Claims, 4 Drawing Sheets

MOBILE PHONE CONNECTOR

BACKGROUND OF THE INVENTION

1. Field of the Invention

The present invention relates to a mobile phone connector, particularly to a compact and thin mobile phone connector for connecting a DC charging plug with a mobile phone.

2. Description of the Prior Art Charging device is the essential equipment of a mobile phone. A conventional mobile phone connector is generally equipped with a charging slot for connecting a DC charging plug with a mobile phone. The charging slot is often defined in a plastic casing of the mobile phone connector. The plastic casing is required to be of a certain thickness to ensure the strength thereof. Therefore, the size of the conventional mobile phone connector is undesired. FIGS. 8 and 9 illustrate such a conventional mobile phone connector 70 assembled to a foundation plate 71 of the mobile phone. The conventional mobile phone connector 70 has a height of approximately 6.8mm. Such a size does not meet the trend for compactness. Furthermore, external interference tends to result in an improper signal transmission of the conventional mobile phone.

SUMMARY OF THE INVENTION

Therefore, an objective of the present invention is to provide a mobile phone connector with small size.

Another objective of this invention is to provide a mobile phone connector which effectively shields from undesired signal interference.

A further objective of this invention is to provide a mobile phone which prevents misconnection of a DC charging plug therewith.

A mobile phone connector of the present invention is characterized in that: the mobile phone connector has an integral enveloping unit and an insulating unit received in the enveloping unit. The insulating unit comprises a first charging terminal unit formed on a side thereof and a second charging terminal unit extending from an end of the first charging terminal unit. The enveloping unit, the first charging terminal unit and the second charging terminal unit defines a DC charging slot for accommodating a mating DC charging plug. The second charging terminal unit is shorter than a transverse portion of the first charging terminal unit for positioning the DC charging plug in the mobile phone connector.

Another characteristic of the mobile phone connector of the present invention lies in that, the mobile phone connector has contact point terminals that can be connected to a fixed charging unit, thereby providing charging functions to an automobile, an airplane or other traveling vehicles.

BRIEF DESCRIPTION OF THE DRAWINGS

The invention can be fully understood by reading the following detailed description of the preferred embodiments, with reference made to the accompanying drawings, wherein.

DESCRIPTION OF THE PREFERRED EMBODIMENT

Figure 1:
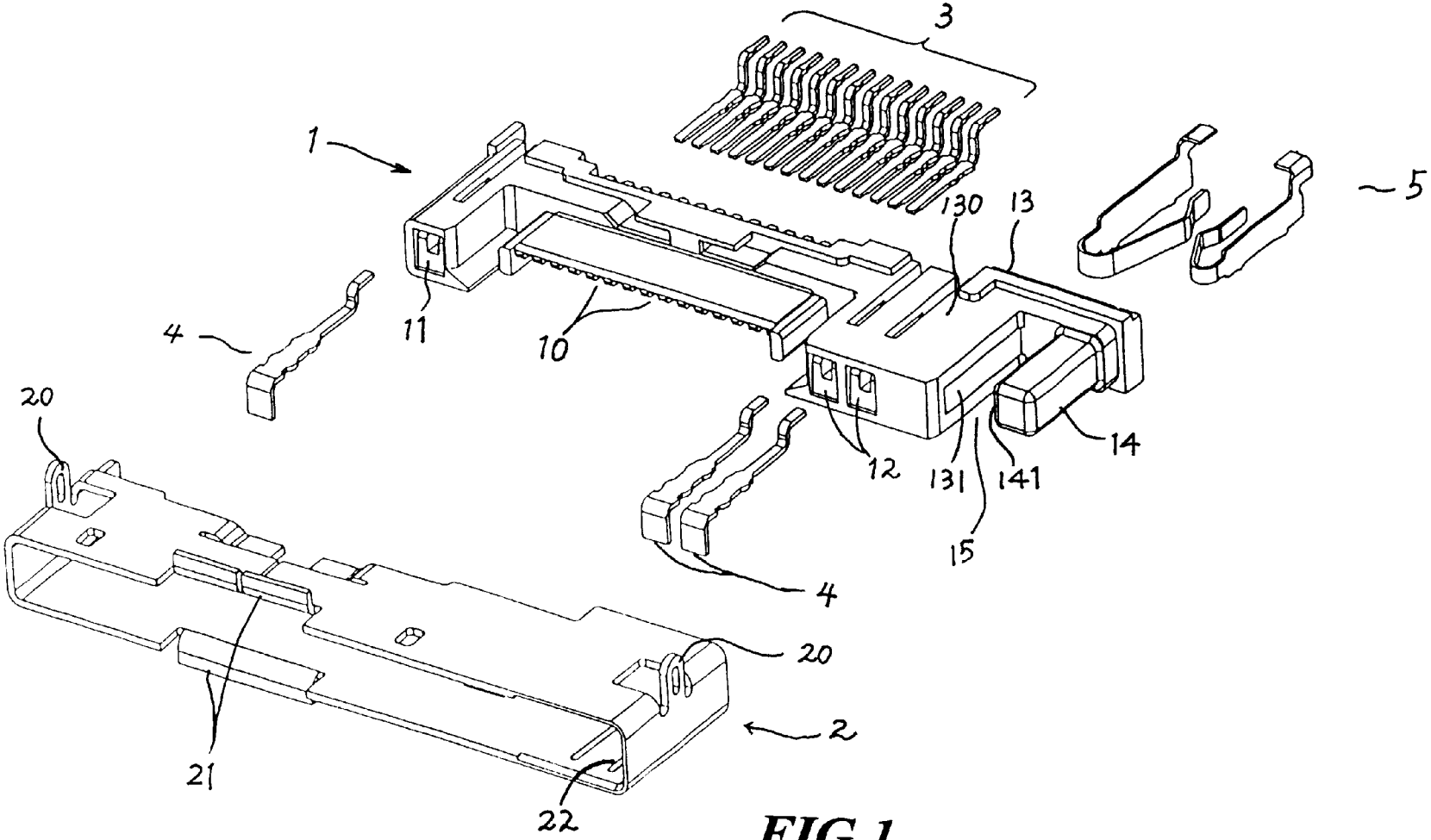
FIG. 1 is an exploded view of a mobile phone connector of the present invention.

As illustrated in FIG. 1, a mobile phone connector of the present invention comprises an insulating unit 1, an enveloping unit 2, a plurality of terminals 3, three contact point terminals 4 and a pair of charging terminals 5. The insulating unit 1 is rectangular and defines a plurality of terminal accommodating grooves 10 for accommodating terminals 3 therein. A contact point accommodating groove 11 is transversely defined beside a side of the insulating unit 1, and a pair of contact point accommodating grooves 12 are transversely defined beside an opposite side of the insulating unit 1. An L-shaped first charging terminal unit 13 is formed on a side of the insulating unit 1 and has a transverse portion 130 adjacent a side of the insulating unit 1. A second charging terminal unit 14 extends from an end of the first charging terminal unit 13. The first charging terminal unit 13 and the second charging terminal unit 14 define a connecting space 15 therebetween. The second charging terminal unit 14 is slightly shorter than the transverse portion 130 of the first charging terminal unit 13 for positioning a mating DC charging plug 61, thereby preventing incorrect insertion of the DC charging plug 61 into the connecting space 15. A pair of side openings 131, 141 are respectively defined in the first and the second charging terminal unit 13, 14 and are opposing to each other.

Figure 4:
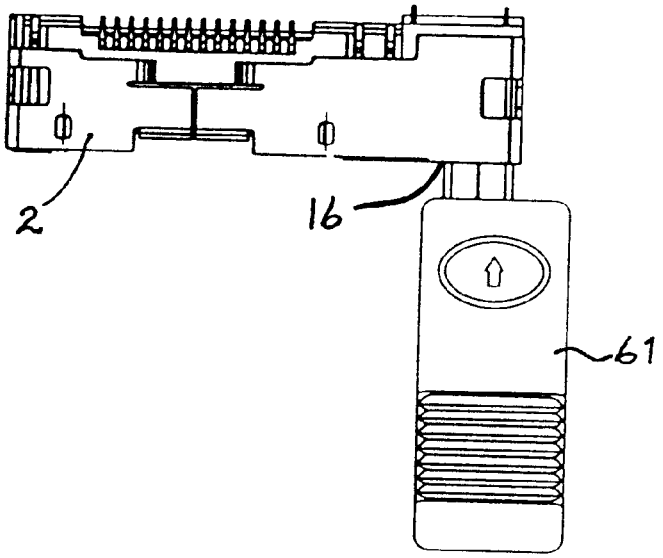
FIG. 4 is a top view of the mobile phone of FIG. 2 and a DC plug connected to a DC charging slot of the mobile phone connector.
Figure 5:
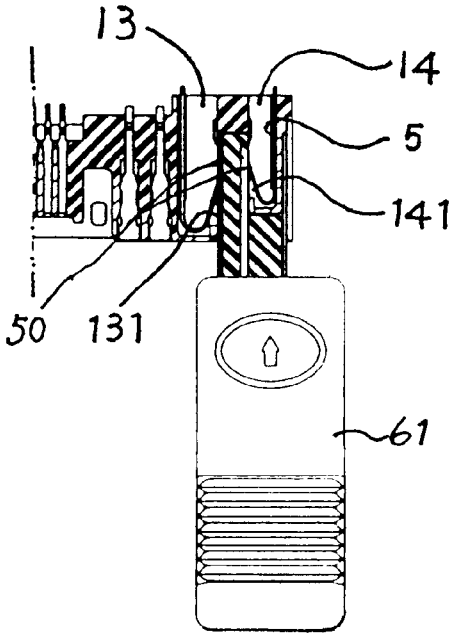
FIG. 5 is similar to FIG. 4, but only showing a partially cross-sectional view of the mobile phone to illustrate a first charging terminal unit and a second charging terminal unit.
Figure 8:
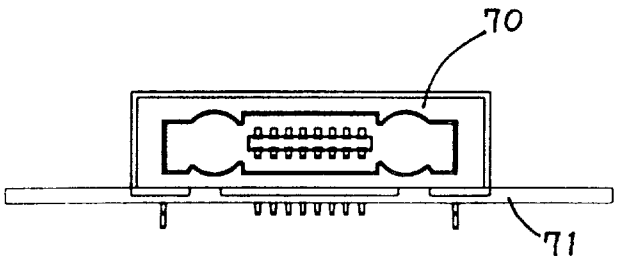
FIG.8 PRIOR ART
FIG. 8 is a front view of a conventional mobile phone connector assembled to a circuit board.
Figure 9:
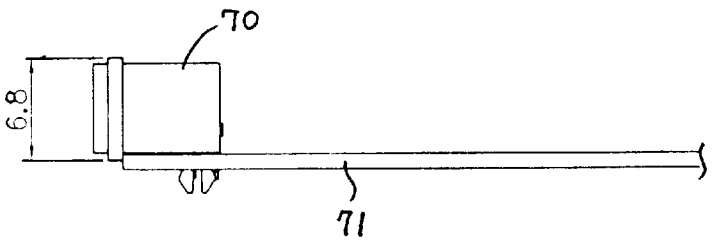
FIG.9 PRIOR ART
FIG. 9 is a side view of the conventional mobile phone connector of FIG. 8.

Further referring to FIGS. 4 and 5, the enveloping unit 2 is integrally formed of a metal sheet for shielding the insulating unit I therein. A position post 20 upwardly extends from an edge of each lateral side of the enveloping unit 2 for positioning the mobile phone connector onto a circuit board 60 (shown in FIG. 7). A pair of stop plates 21 are bent respectively from front edges of an upper side and a lower side (not labeled) thereof for abutting against a side of the circuit board 60. A flexible check plate 22 is punched inwardly and slantwise from the lower side of the enveloping unit 2. The check plate 22 has a thickness gradually reduced towards a free end thereof for enhancing flexibility. The check plate 22 forms a step part 221 adjacent the lower side of the enveloping unit 2 for enhancing resiliency thereof.

Figure 2:
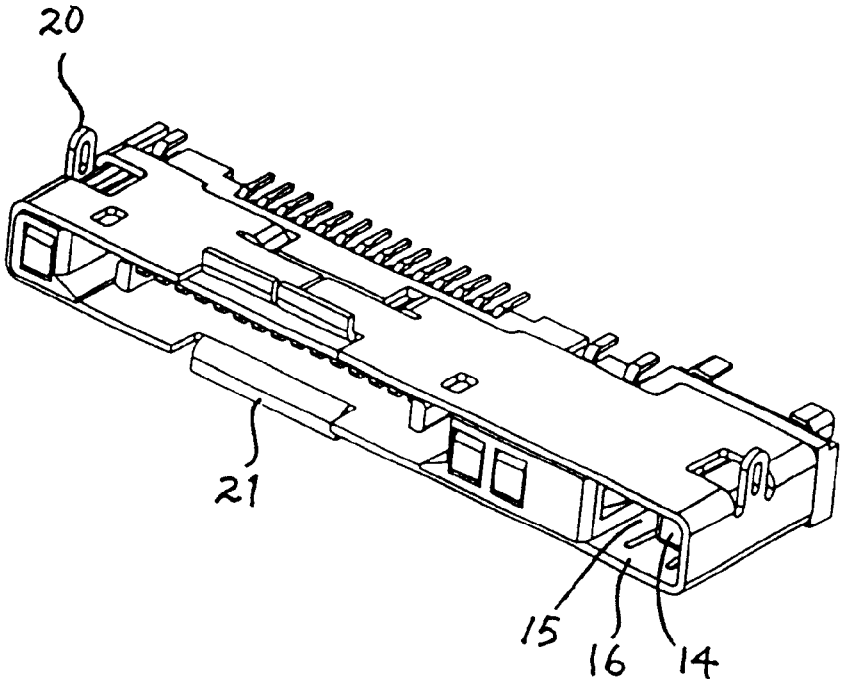
FIG. 2 is an assembled view of the mobile phone connector FIG. 1.
Figure 3:
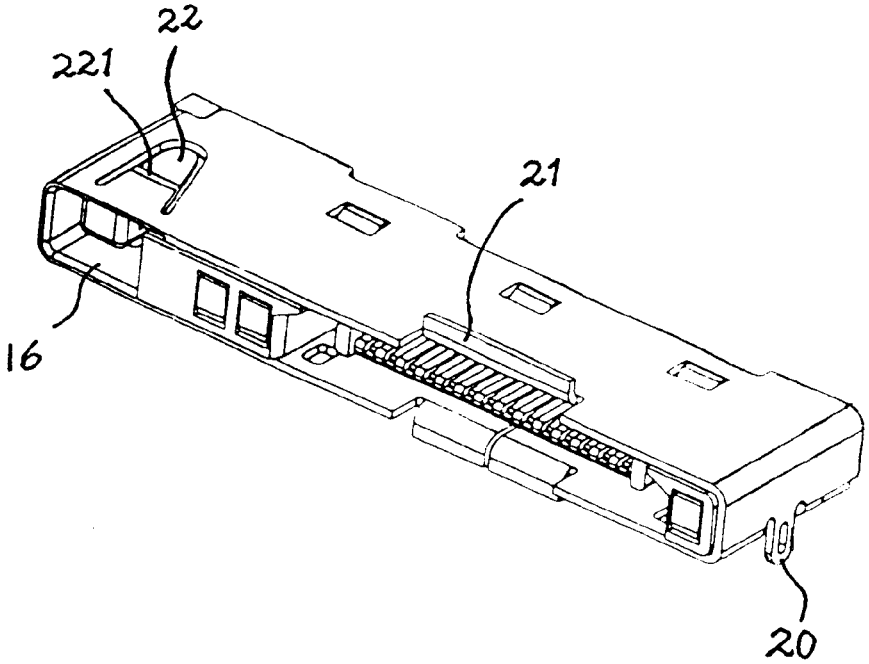
FIG. 3 is another view of the mobile phone connector of FIG. 2, wherein the mobile phone connector of FIG. 2 is located upside down.

In assembly, referring to FIGS. 2 and 3, the terminals 3 are respectively received in the terminal accommodating grooves 10. The contact point terminals 4 are respectively received in the first contact point accommodating groove 11 and the second contact point accommodating grooves 12. The enveloping unit 2 shields the insulating unit 1 therein. The charging terminals 5 are respectively received in the side slots 131, 141 and are opposing to each other. The enveloping unit 2, the first charging terminal unit 13 and the second charging terminal unit 14 forms a DC charging slot 16 for receiving a mating portion (not labeled) of a mating DC charging plug 61 therein (shown in FIGS. 4 and 5).

With reference to FIGS. 4 and 5, the mating portion of the DC charging plug 61 is received in the DC charging slot 16. The check plate 22 extends into the DC charging slot 16 and presses against the DC charging plug 61 for firmly clamping the DC charging plug 61 in the DC charging slot 16. A contact end 50 of the DC charging plug 61 is received in the connecting space 15 and electrically connects with the charging terminals 5.

Figure 6:
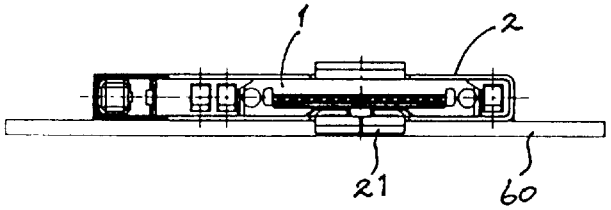
FIG. 6 is a front view of the mobile phone connector of FIG. 2 as it is assembled to a circuit board.
Figure 7:
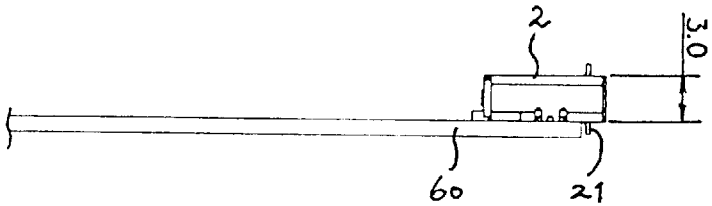
FIG. 7 is a side view of the mobile phone connector of FIG. 2 as it is assembled to the circuit board.

As shown in FIGS. 6 and 7, the DC charging plug 61 is secured directly in the enveloping unit 2 while not in the insulating unit 1, so the whole height of the mobile phone connector is reduced by about 3mm. This design makes the mobile phone connector smaller and lighter.

In conclusion, the invention has the following advantages over the prior art. The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretations so as to encompass all such modifications and similar arrangements.

What is claimed is:

1. A mobile phone connector adapted to be welded onto a circuit board of a mobile phone for connecting a DC charging plug with the mobile phone, comprising:

a rectangular insulating unit defining a plurality of terminal accommodating grooves for respectively receiving terminals therein, and contact point terminal accommodating grooves for respectively accommodating a plurality of contact point terminals therein, a charging terminal unit being formed on the insulating unit for receiving charging terminals therein;

an integral enveloping unit being made of metal, enveloping said insulating unit characterized in that:

Said enveloping unit, in combination with the charging terminal unit of the insulating unit, defining a DC charging slot for receiving the DC charging plug.

2. The mobile phone connector as claimed in claim 1, wherein said check plate forms at least one depressed step part for enhancing resiliency thereof.

3. The mobile phone connector as claimed in claim 1, wherein said check plate has a thickness reducing towards a free end thereof to reinforce the operating flexibility thereof.

4. The mobile phone connector as claimed in claim 1, wherein one contact point accommodating groove is defined beside a side of the insulating unit, and two grooves are defined beside an opposite side of the insulating unit.

5. The mobile phone connector as claimed in claim 1, wherein said charging terminal unit includes a first charging terminal unit and a second charging terminal unit extending from an end of the first charging terminal unit, a connecting space being defined between the first and the second charging terminal units.

6. The mobile phone connector as claimed in claim 5, wherein the first charging terminal unit has a transverse portion adjacent a side of the insulating unit, and the second charging terminal unit is slightly shorter than the transverse portion for positioning the DC charging plug.

7. The mobile phone connector as claimed in claim 5, wherein a pair of side openings are respectively defined in the first charging terminal unit and the second charging terminal unit and are opposing to each other for receiving the charging terminals.

8. The mobile phone connector as claimed in claim 1, wherein a pair of stop plate are respectively bent from an upper side and a lower side of the enveloping unit.

9. A mobile phone connector adapted to be welded on a circuit board of a mobile phone for connecting an external device with the mobile phone, comprising:

a rectangular insulating unit defining a plurality of terminal accommodating grooves for respectively receiving terminals therein, and a plurality of contact point terminal accommodating grooves for respectively accommodating a plurality of contact point terminals therein, and a first charging terminal unit being formed on the insulating unit and a second charging terminal unit extending from an end of the first charging terminal unit respectively for receiving charging terminals therein; and an enveloping unit being integrally formed of a metal sheet and shielding the insulating unit;

wherein the enveloping unit and the first and the second charging terminal units of the insulating unit define a DC charging slot for receiving the external device.

10. The mobile phone connector as claimed in claim 6, wherein a pair of side openings are respectively defined in the first charging terminal unit and the second charging terminal unit and are opposing to each other for receiving the charging terminals.

11. A mobile phone connector adapted to be welded on a circuit board of a mobile phone for connecting an external device with the mobile phone, comprising:

a rectangular insulating unit defining a plurality of terminal accommodating grooves for respectively receiving terminals therein, and a plurality of contact point terminal accommodating grooves for respectively accommodating a plurality of contact point terminals therein, and a first charging terminal unit being formed on the insulating unit and a second charging terminal unit extending from an end of the first charging terminal unit respectively for receiving charging terminals therein; and an enveloping unit being integrally formed of a metal sheet and shielding the insulating unit;

wherein the enveloping unit and the first and the second charging terminal units of the insulating unit define a DC charging slot for receiving a mating portion of a mating DC charging plug.

12. The mobile phone connector as claimed in claim 11, wherein the first charging terminal unit is L-shaped and has a transverse portion adjacent a side of the insulating unit, and the second charging terminal unit is slightly shorter than the transverse portion for positioning the DC charging plug.

* * * * *